US007893328B1

(12) United States Patent
Rigaud et al.

(10) Patent No.: US 7,893,328 B1
(45) Date of Patent: Feb. 22, 2011

(54) NECK AND BODY JOINT FOR A MUSICAL INSTRUMENT

(75) Inventors: Robert Joseph Rigaud, 2819 Kivett Dr., Greensboro, NC (US) 27407; John Mark Hampton, Greensoro, NC (US)

(73) Assignee: Robert Joseph Rigaud, Greensboro, NC (US)

( * ) Notice: Subject to any disclaimer, the term of this patent is extended or adjusted under 35 U.S.C. 154(b) by 42 days.

(21) Appl. No.: 12/413,080

(22) Filed: Mar. 27, 2009

(51) Int. Cl.
*G10D 1/08* (2006.01)

(52) U.S. Cl. ..... 84/267

(58) Field of Classification Search ..... 84/267, 84/291, 293, 290
See application file for complete search history.

(56) References Cited

U.S. PATENT DOCUMENTS

| | | | | |
|---|---|---|---|---|
| 57,540 | A | 8/1866 | Mein | |
| 508,858 | A | 11/1893 | Back | |
| 600,507 | A | 3/1898 | Bremerman | |
| 608,279 | A | 8/1898 | Benson | |
| 1,707,192 | A | 3/1929 | Overton | |
| 2,469,582 | A | 5/1949 | Strong | 84/293 |
| 4,027,570 | A | 6/1977 | Rendell et al. | 84/293 |
| 5,233,122 | A | 8/1993 | Kim | 84/293 |
| 5,452,637 | A | 9/1995 | DeCola | 84/291 |
| 6,350,939 | B1 | 2/2002 | Griffiths | 84/293 |
| 7,041,889 | B1 | 5/2006 | Hsieh | 48/291 |
| 2007/0277665 | A1 | 12/2007 | Kroeger et al. | 84/293 |
| 2009/0173207 | A1 * | 7/2009 | Leach | 84/293 |

* cited by examiner

*Primary Examiner*—Kimberly R Lockett
(74) *Attorney, Agent, or Firm*—MacCord Mason PLLC

(57) ABSTRACT

A framework for a stringed musical instrument includes a body having a first interlocking interface in an outside face, a neck having a distal end and a proximal end with a second interlocking interface in the proximal end, and a key configured with first and second portions. One of the key portions is configured to interlock in the first interface on the outside face and the other of the portions is configured to interlock in the second interface of the proximal end such that the body and neck are held together, at least in part, by their common interlocking with the key.

18 Claims, 10 Drawing Sheets

NECK AND BODY JOINT FOR A MUSICAL INSTRUMENT

BACKGROUND OF THE INVENTION

1. Field of the Invention

The present invention relates to musical instruments, and more particularly to a framework for stringed musical instruments having a body, neck and key.

2. Description of the Related Art

Stringed instruments such as guitars, basses, violins, and cellos have a common dynamic of string tension opposing a sound chamber (body) and notating extension (neck). The mechanical joint between these two parts has long been a source of major concern to those who manufacture these instruments. Stress and tension produced by strings apply forces to this joint, which make it equal to the most critical components of any musical instrument. Even the finest instruments, being made of wood, will require adjustment of these two parts. The violin family of stringed instruments has traditionally employed the use of an adhesive that releases readily by the application of heat and moisture (steam). The steel stringed acoustic guitar requires more strength in its body to neck (heel) joint than the violin family of instruments.

Traditionally, the steel stringed acoustic guitar heel joint has been a tapered "dove-tail" design. This joint does work well and provides adequate strength to oppose the tension produced by the steel-strings. The disadvantages of the dove-tail joint are that it is time consuming in the manufacturing process and troublesome to remove for service.

Because of the disadvantages of the dove-tail joint design, some have employed a direct-bolt method which allows neck assembly without the use of adhesives. This has been far reaching and accepted in most guitar manufacture both small and great. However, in the levels of high-end guitar building, bolts are considered inferior in aesthetics, and to some, sonic efficiency.

SUMMARY OF THE INVENTION

The present invention addresses this challenge to guitar builders. Of concern in the connection of the neck to body is the sonic transfer through the mechanical joint of the neck and body and this is affected by the area of the surface bearing contact between the neck and body. Applicant's improved joint allows easy access to its working parts, and improves the aesthetic nature of the joint. These features can be used in all levels of stringed instrument manufacture, even higher-end production.

Applicant's key is an object which is inserted into complementary receptor channels on both neck and body. The purpose of the key is to provide adequate opposing surface contact to resist lateral forces applied to the joint via the guitar strings. This surface contact, accompanied by poly vinyl acetate adhesive, will more than suffice for the joint's demands.

Wood screws on the neck portion of the joint may provide two-fold advantages; a) to provide additional surface tension to the neck-heel section of the joint; and b) upon their removal, to provide easy access to the internal area of the joint for steam application and neck removal.

A cover for the heel-cap is held in place by magnets, which allow clean and easy access to the mechanical elements of the key.

The use of magnets employed to fasten any cover for a guitar instead of screws is novel, and never before used in this fashion in the marketplace.

One aspect of the invention is such "magnet fastening" of plates in any fashion, as it applies to stringed instruments, both electric and acoustic.

The system assists the modern guitar maker by a) providing a consistent and reliable method to join neck to body without using direct-mounting bolts or traditional dove-tail technology; b) enablement of improved neck removal characteristics for future service and repair needs; and c) improving efficiency of neck-to-body sonic relationship by producing more solidity to the mechanical contact between the two entities.

The present invention fulfills one or more of these needs in the art by providing a stringed musical instrument including a framework including a body and neck. The body has a first interlocking interface in an outside face. The neck has a distal end and a proximal end with a second interlocking interface in the proximal end. A key is configured with first and second portions. One of the portions is configured to interlock in the first interface on the outside face and the other of the portions is configured to interlock in the second interface of the proximal end of the neck, such that the body and neck are held together by their common interlocking with the key. The framework may have the usual strings, frets, etc. added to it to makeup the completed stringed instrument.

The stringed musical instrument typically has a wooden body with a sound box. The neck is typically wood and a heel in the proximal end has a surface that is shaped to complement the outside of the body at its contact area and presses against the outside of the sound box sufficient to provide excellent sound transmission between the neck and the body.

The key is preferably wood and is configured with first and second trapezoidal lobes. One of the lobes is configured to interlock with the first interface on the outside face of the body and the other of the lobes configured to interlock with the second interface within the proximal end of the neck. The second interface in the neck may have two channels, and the lobe of the key that fits into the second interface may have two channels, with each of the channels in the interface opposing one of the channels in the lobe of the key to form an elongated hole. There may also be a pin located in each elongated hole. Glue is preferably used for bonding the surface of the heel, the outside face of the body and the key. In some embodiments a cover plate conceals the pins, with a magnet holding the cover plate in position.

The present invention may also be considered to be a method of securing a neck to a body of the framework of a stringed musical instrument. This includes forming a first interlocking interface in an outside face of a body, and forming a second interlocking interface in a proximal end of a neck. The method includes inserting a key that has first and second portions into the interfaces so that one of the portions interlocks with the first interface on the outside face of the body and the other of the portions interlocks with the second interface within the proximal end of the neck.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1A:
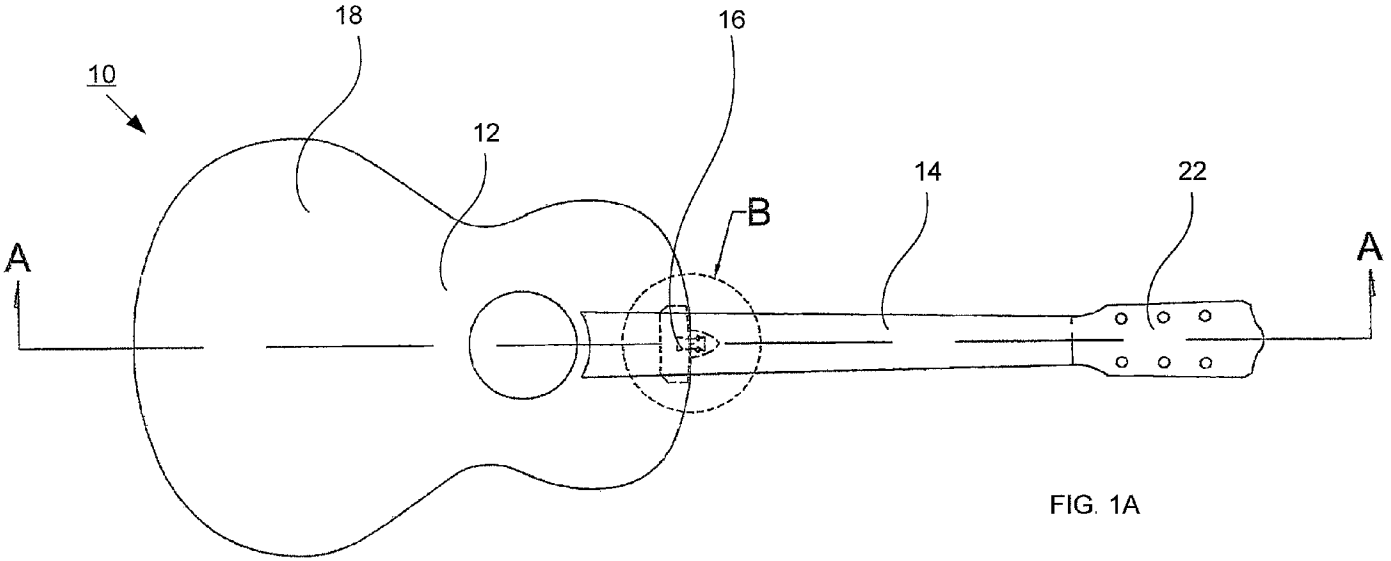
FIG. 1A is a top view of the framework of a stringed instrument constructed according to an embodiment of the present invention.
Figure 1B:
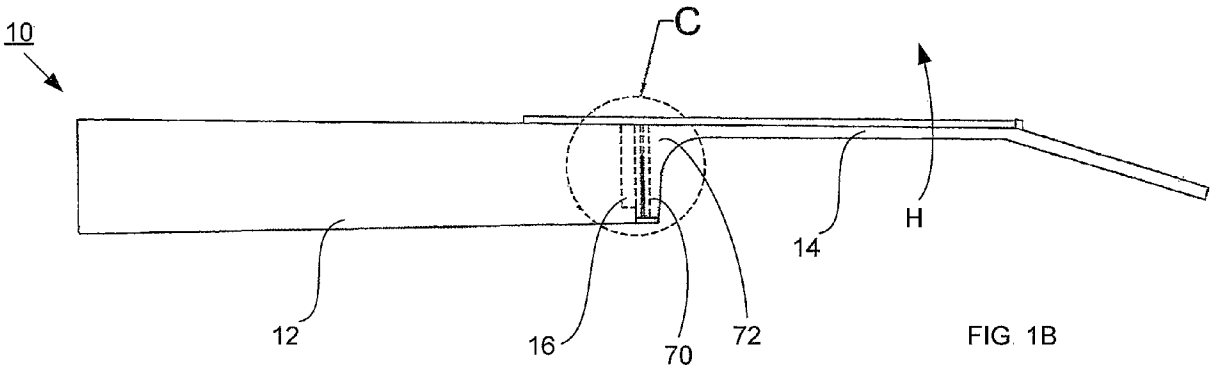
FIG. 1B is a sectional view of the instrument of FIG. 1A taken along lines A-A and looking in the direction of the arrows.

As best seen in FIG. 1A and FIG. 1B, there is shown a top and side view of the framework of a guitar-like stringed instrument, generally designated as 10. Included within the scope of the invention are neck and body attachments for guitars, basses, violins, and cellos. Guitar framework 10 includes a body 12, a neck 14, and a key 16. The body 12 has a soundbox 18. The neck 14 has a headstock 22, and strings (not shown) are strung from headstock 22, along neck 14 and to soundbox 18 to complete the instrument. Tension on the strings applies force to the intersection of the body 12 and neck 14. Key 16, situated between body 12 and neck 14, provides adequate tension to resist lateral forces applied via instrument strings.

Figure 2:
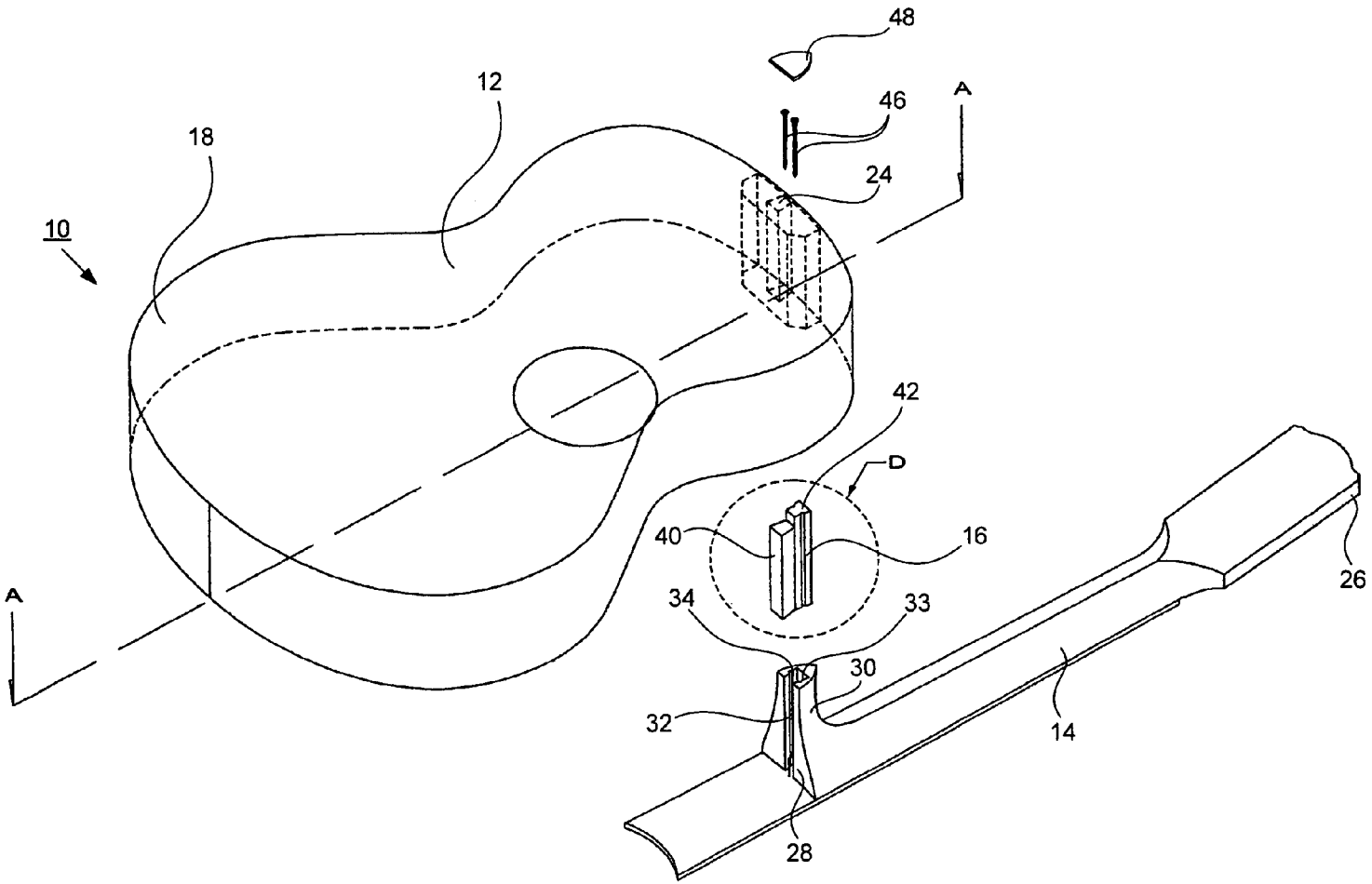
FIG. 2 is an exploded, perspective view of the instrument shown in FIG. 1A.

FIG. 2 shows a body 12 having a first interlocking interface 24 in an outside face of body 12. First interlocking interface 24 has a complementary shape to a first portion 40 of a key 16. Neck 14 has a distal end 26 and a proximal end surface 28. At proximal end 28 is heel 30. A groove in heel 30 forms a second interlocking interface 32. Inside of interlocking interface 32 are two channels 33 and 34. The interface 32 and second portion 42 of the key 16 are of complementary shape, also.

Figure 3:
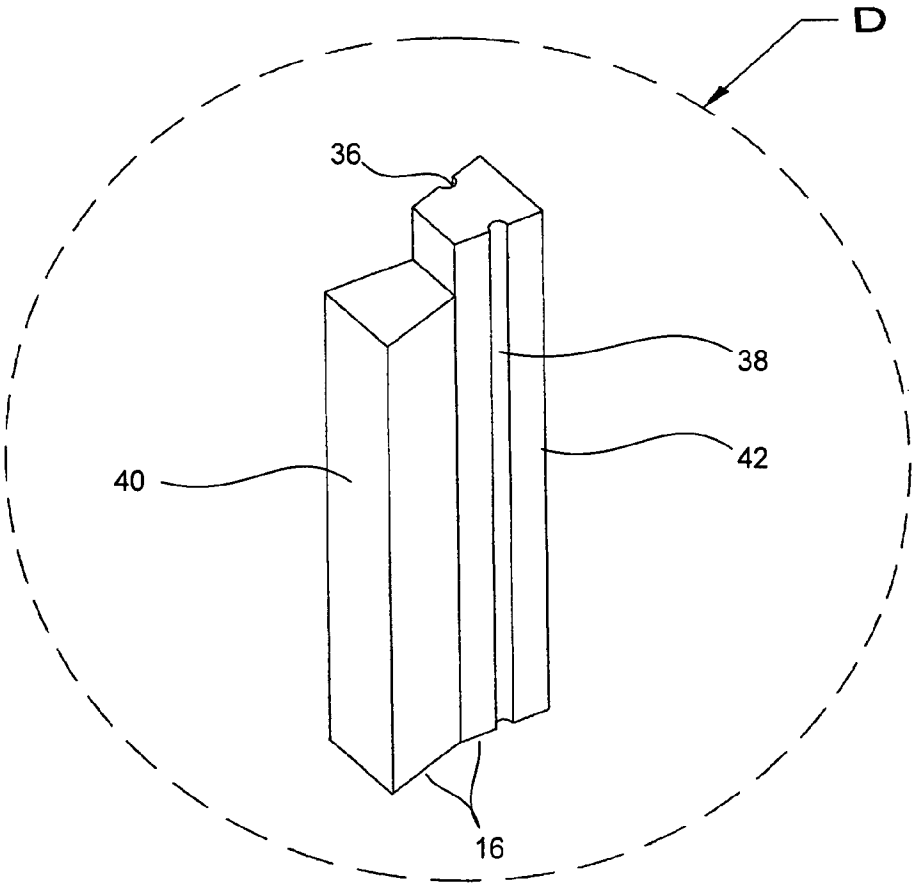
FIG. 3 is an enlarged view of the key of the instrument shown in FIG. 1A.

Channels 33 and 34 match with two key channels 36 and 38, as best seen in FIG. 3. Key 16 includes a first portion lobe 40 configured to interlock in the first interface 24 in body 12 and a second portion lobe 42 configured to interlock in the second interface 32 of the proximal end surface 28 of neck 14. Key 16 preferably has two trapezoidal portion lobes, as shown, but others may prefer other shapes which are considered to be within the scope of the present invention. The key 16 is a one-piece item having a cross-section shape of the two lobes, preferably trapezoidal lobes.

Figure 4:
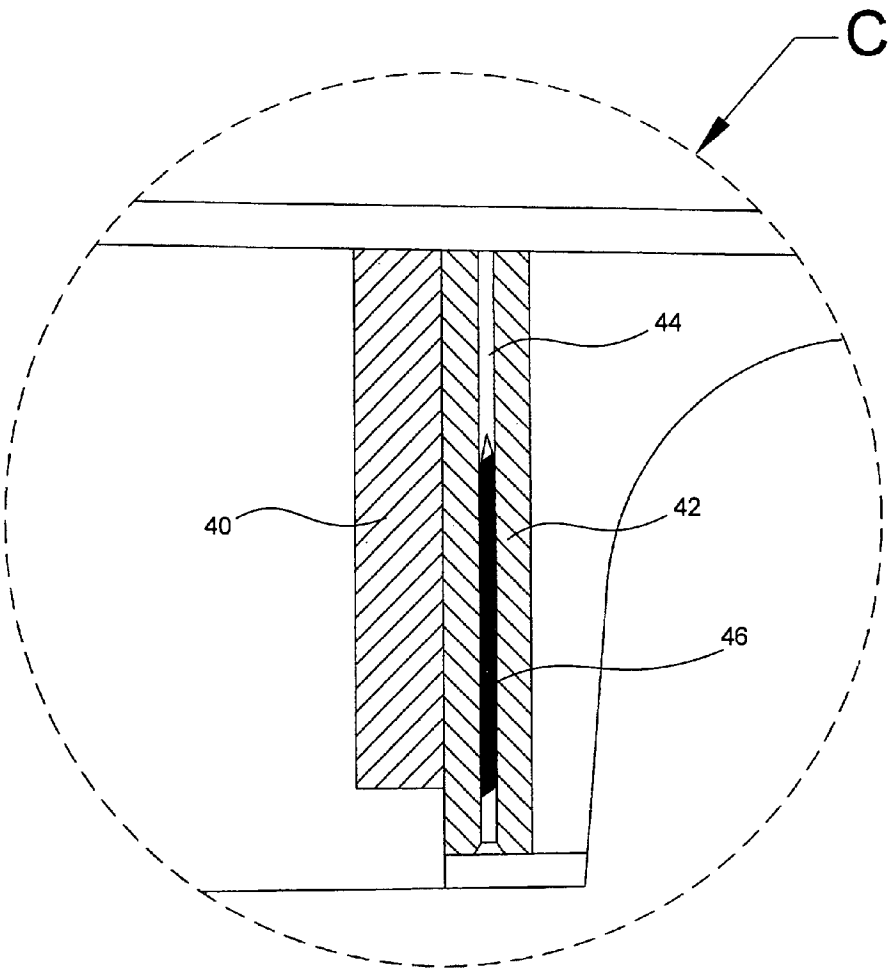
FIG. 4 is an enlarged cross-sectional view along the portion of the instrument shown encircled with a dotted line C in FIG. 1.

As seen in FIG. 4, when channels 36 and 38 of key 16 and channels 33 and 34 of the interlock interface of a proximal end surface 28 of neck 14 mate, elongated holes 44 are formed. In the preferred embodiment pins 46 are inserted into elongated holes 44, providing additional tension to the heel section 30 of the instrument joint. Pins 46 may take the form of screws, nails, inserts, etc. and be composed of non-wooden materials, all of which are within the scope of the present invention. Pins 46 occupy the holes 44, so removal of the pins provides easy access to internal areas of the body 12, key 16 and the neck 14 interface to enable steam to be injected to loosen glue in the joint and allow neck 14 removal. The use of a key 16 and pins 46 stabilize the overall guitar framework while also allowing for improved serviceability.

Figure 5:
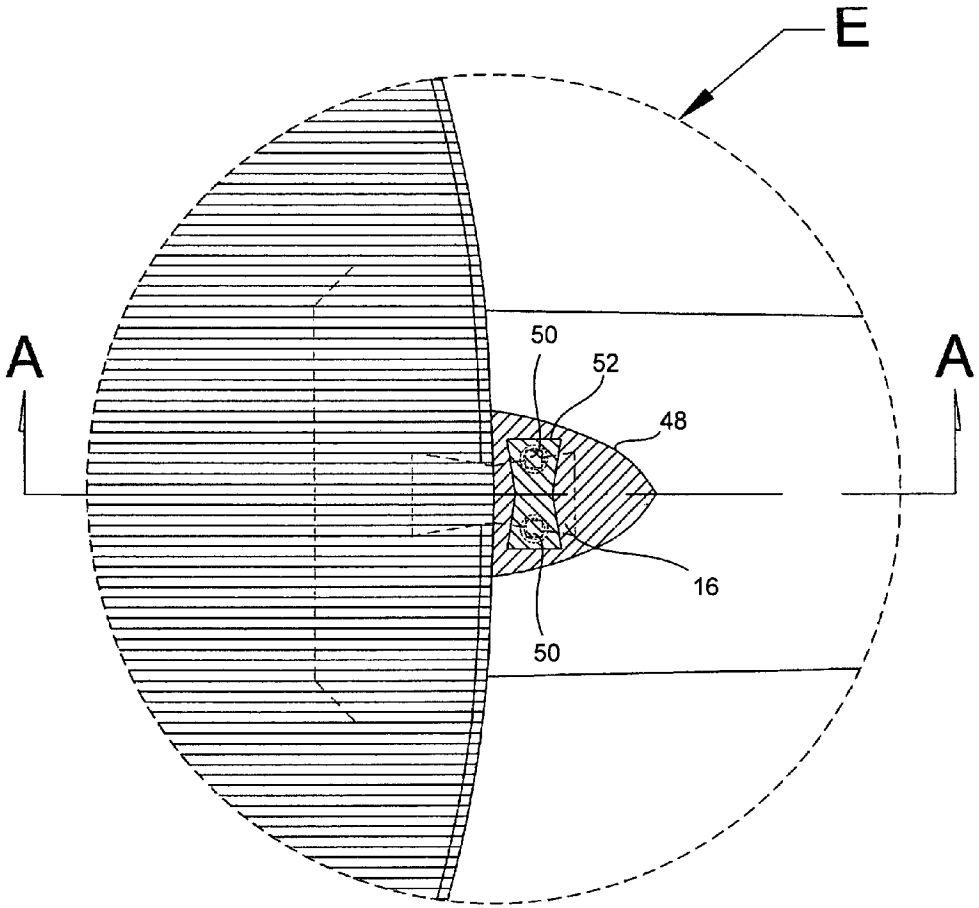
FIG. 5 is an enlarged sectional view of the portion of the instrument shown encircled with a dotted line B in FIG. 1 where the neck, body and key join.
Figure 6:
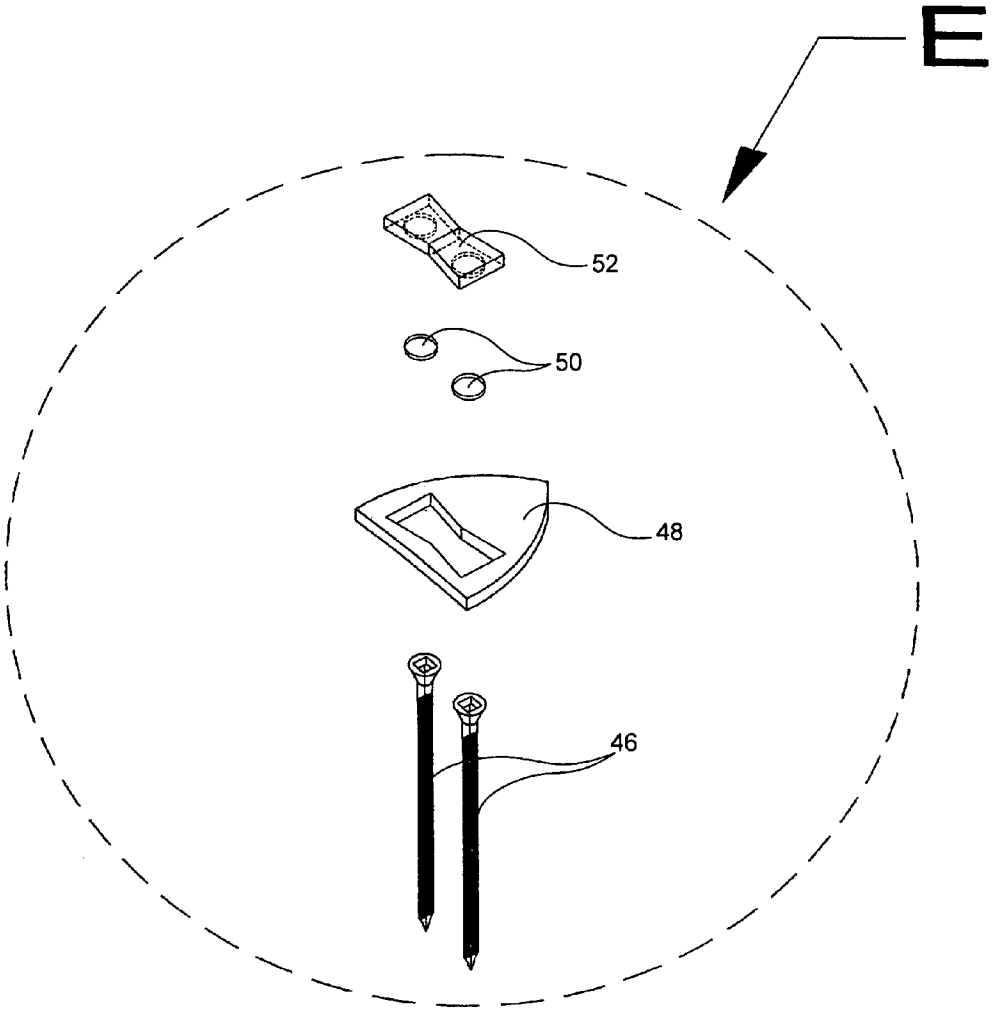
FIG. 6 is an exploded perspective view of the section of the instrument shown in FIG. 1 covering the neck and key joint.

FIGS. 5 and 6 illustrate a preferred embodiment. Once the interfaces 24 and 32 are interlocked with the lobes 40 and 42 of key 16, and pins 46 secured, heel cover 48 conceals the second interface 32 and second portion lobe 42 joint. Magnets 50 that are embedded in the heel secure the heel cover 48 and cap cover plate 52 into position. The use of magnets 50 provide for clean and easy access to the mechanical elements surrounding the key 16 without the use of visible screws.

FIG. 2 illustrates a method of securing a neck 14 to a body 12 of a musical instrument 10 by forming a first interlocking interface 24 in an outside face of a body 12, and forming a second interlocking interface 32 in a proximal end 28 of a neck 14. A key 16 that has first portion 40 and second portion 42 is inserted into the interfaces 24 and 32. First portion 40 interlocks with first interface 24 and the second portion 42 interlocks with second interface 32. Typically, these portions are covered with conventional glue before assembly. Polyvinyl acetate glue is preferred.

When, in the preferred embodiment, body 12 and neck 14 are held together by their common interlocking with key 16, the proximal end surface 28 intimately touches the outside of the sound box 18, providing enhanced direct surface interaction between neck 14 and soundbox 18. This enhanced surface interaction improves the sound transmission between the neck 14 and the body 12. A poly vinyl acetate or other appropriate adhesive may be used in conjunction with the key 16 to assist in resisting lateral force applied to the joint.

The tension on the strings exerts a force on the neck tending to bow the neck in the direction H shown in FIG. 1B. Over time, this has the effect of causing the strings to be spaced away from the neck, making the instrument difficult or impossible to play. At this point, the neck is disassembled, and a part of the face 28 is cutaway to restore the angle of the neck to its proper alignment. As noted above, the instrument originally assembled according to the invention can be easily disassembled, with the key removed from both the neck and the body. The face 28 can then be machined to take off a wedge of material from the face, the wedge being wider at the rear portion 70 of the surface than at the front portion 72 (see FIG. 1B). This removal will have the effect of changing the shape of interface 32, so a complementary matching operation is conducted on the lobe 42 to match the new shape of interface 32 and the instrument can be re-assembled as discussed above.

Figure 2A:
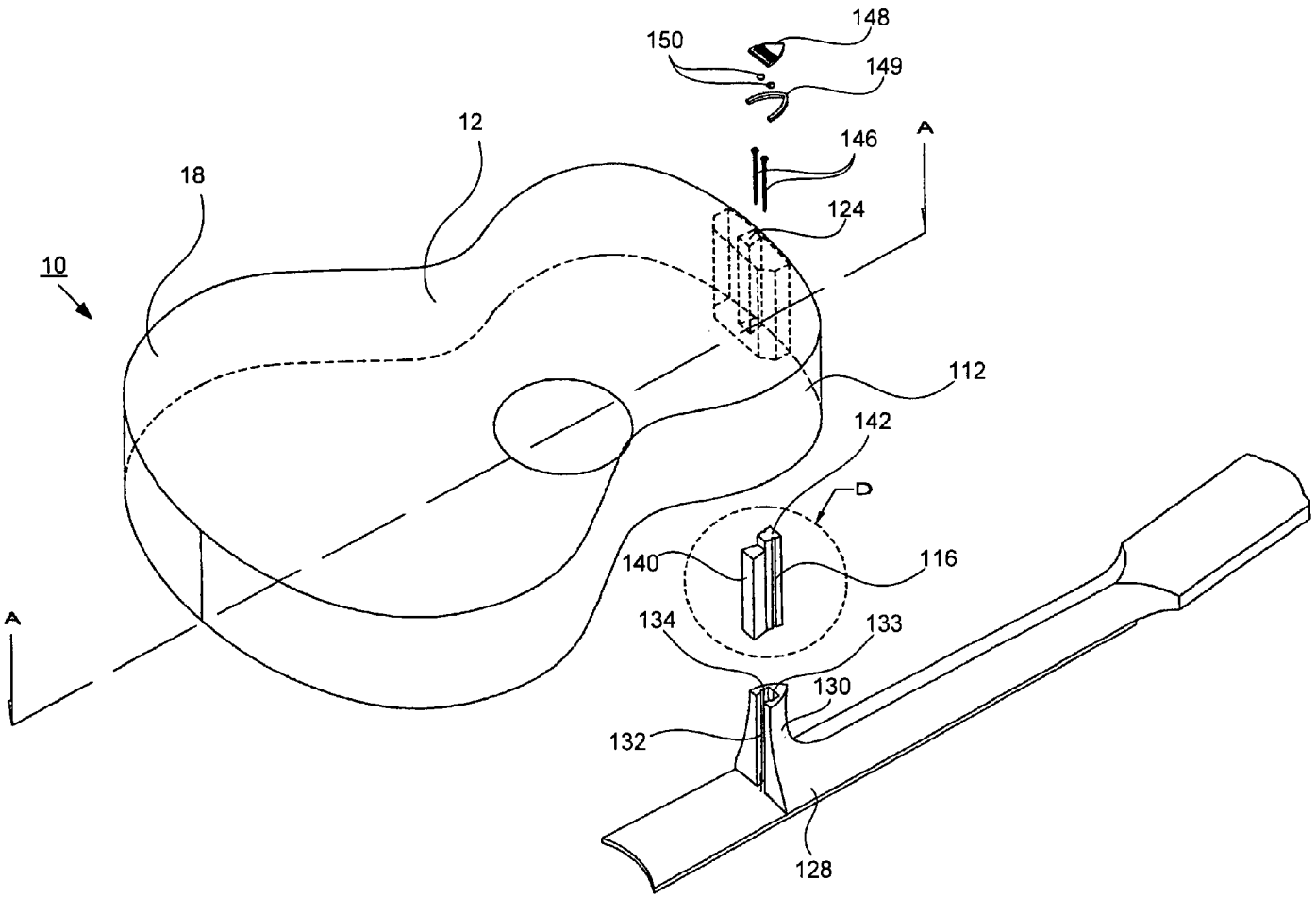
FIGS. 2A, 3A, 5A and 6A are similar to the view of FIGS. 2, 3, 5 and 6 respectively of another embodiment.
Figure 5A:
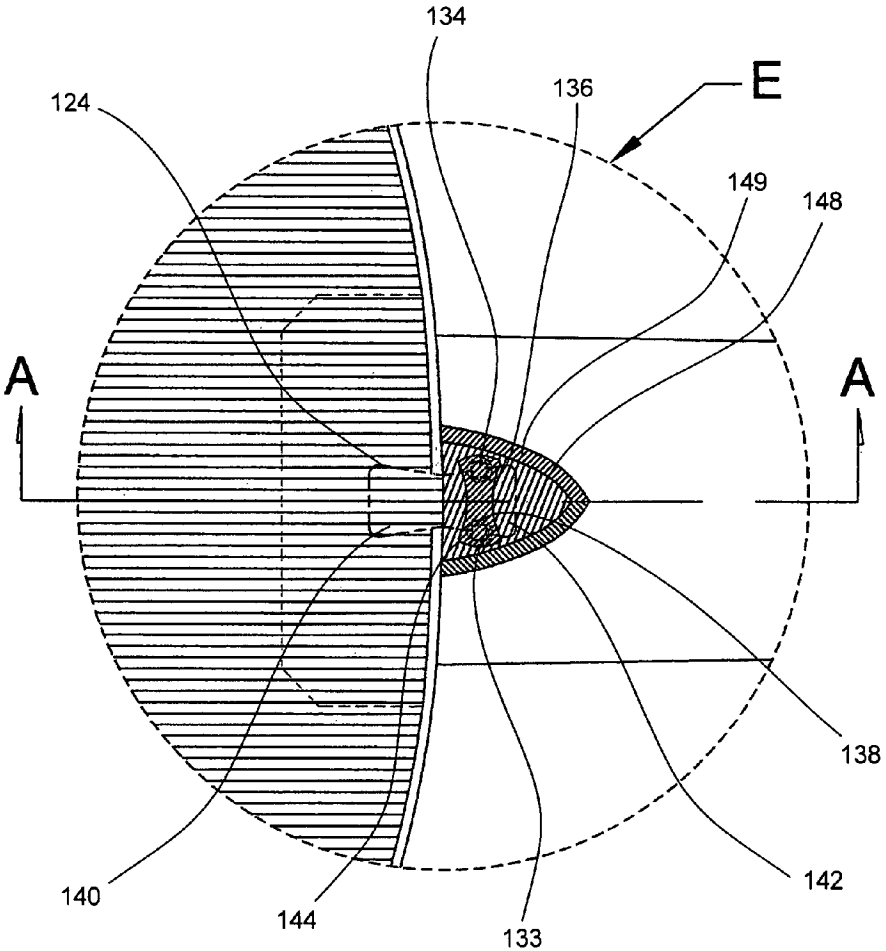

A second embodiment is seen in FIGS. 2A, 3A, 5A and 6A, which are comparable views to those discussed above. Elements shown in common with the prior figures and not discussed with respect to FIGS. 2A, 3A, 5A and 6A are the same as in FIGS. 2, 3, 5 and 6. FIG. 2A shows the heel's proximal end 128 having heel 130. A groove in heel 130 forms a second interlocking interface 132. Inside of interlocking interface 132 are two channels 133 and 134. The interface 132 and second portion 142 of the key 116 are of complementary shape, also. As can be seen, the corners of the key 116 and groove forming interface 132 are rounded. By rounding the corners of the groove, more material is left in the heel 130, resulting in a stronger heel. A heel cover rim 149 affixed to the perimeter of the surface of the heel as shown in FIG. 5A also helps to strengthen the heel.

Figure 3A:
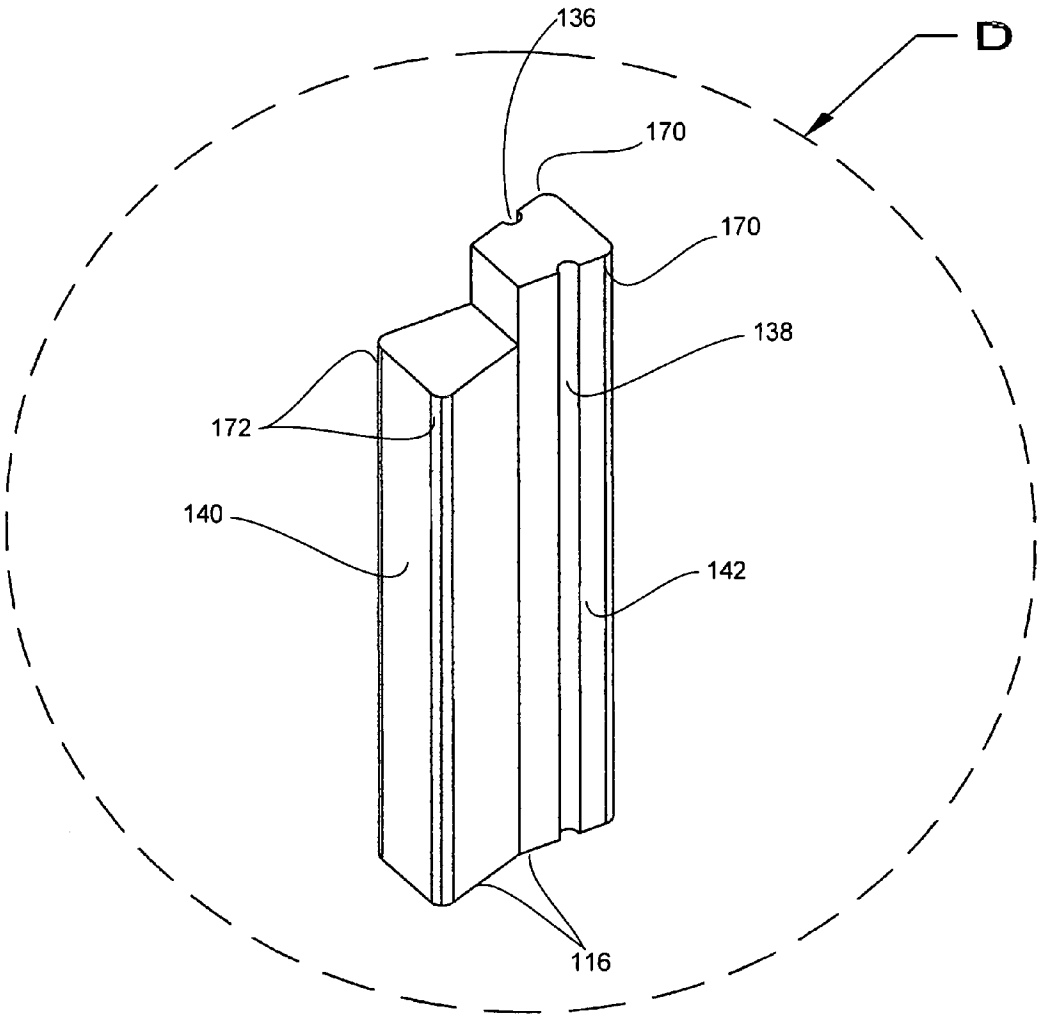

Channels 133 and 134 match with two key channels 136 and 138, as best seen in FIG. 3A. Key 116 includes a first portion lobe 140 configured to interlock in the first interface 124 in the body 112 and a second portion lobe 142 configured to interlock in the second interface 132 of the proximal end surface 128 of the neck.

As seen in FIG. 4A, when channels 136 and 138 of key 116 and channels 133 and 134 mate, elongated holes 144 are formed. As before, pins 146 are inserted into elongated holes 144. Pins 146 occupy the holes 144, so removal of the pins provides easy access to internal areas of the body key 116 and the neck interface 132 to enable steam to be injected to loosen glue in the joint and allow neck removal.

Figure 6A:
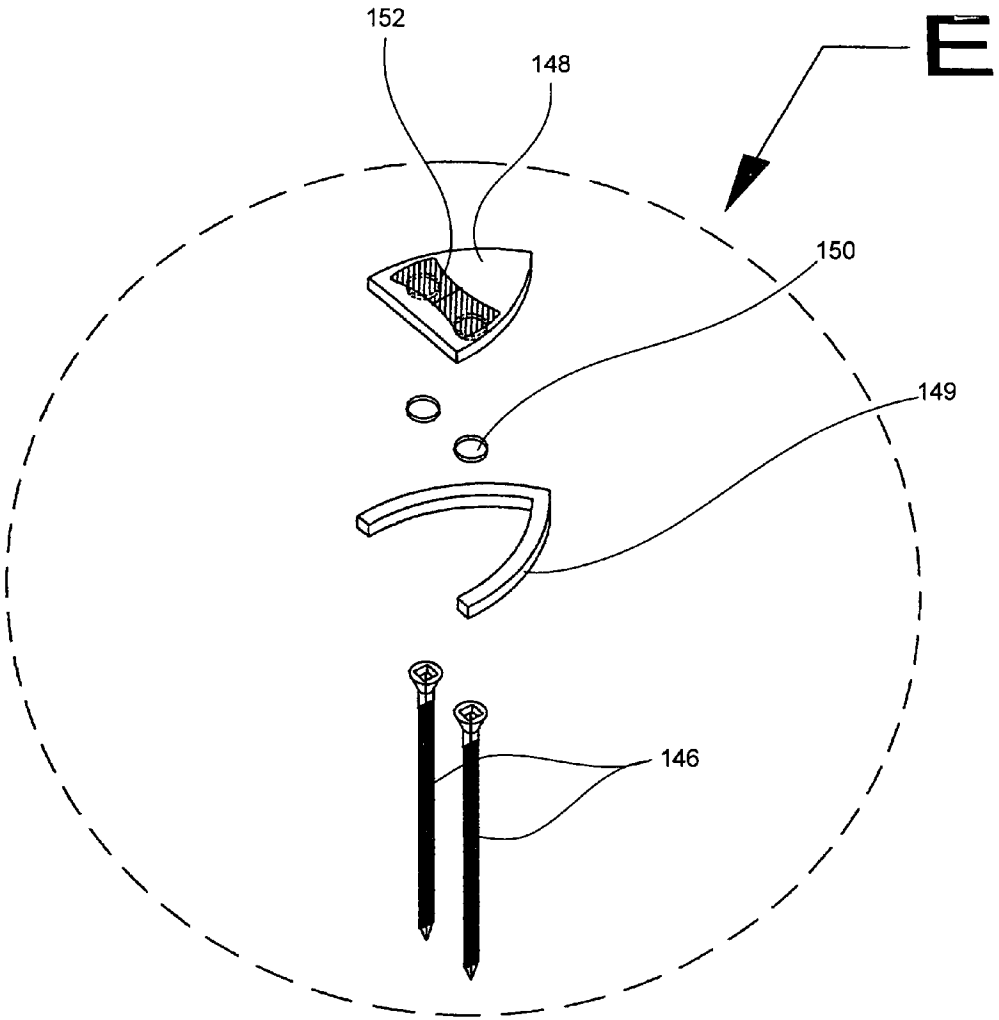

FIGS. 5A and 6A show interfaces 124 and 132 interlocked with the lobes 140 and 142 of key 116, and pins 146 secured. The heel cover rim 149 affixed to the perimeter of the surface of the heel receives the heel cover 148, which conceals the second interface 132 and second portion lobe 142 joint. Magnets 150 that are embedded in the heel secure the heel cover 148 and cap cover plate 152 into position. The use of magnets 150 provide for clean and easy access to the mechanical elements surrounding the key 116 without the use of visible screws.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A framework for a stringed musical instrument comprising:

a body having a first interlocking interface in an outside face, a neck having a distal end and a proximal end with a second interlocking interface in the proximal end, and a key configured with first and second lobed portions, one of the lobed portions configured to interlock in the first interface on the outside face and the other of the lobed portions configured to interlock in the second interface of the proximal end such that the body and neck are held together by their common interlocking with the key.

2. A framework for a stringed musical instrument as claimed in claim 1 wherein the neck has a heel and the second interlocking interface is in the heel.

3. A framework for a stringed musical instrument as claimed in claim 1 wherein the body has a sound box and a surface on the proximal end of the neck intimately touches the outside of the sound box sufficient to provide good quality sound transmission between the neck and the body.

4. A framework for a stringed musical instrument as claimed in claim 1 wherein the key has two lobes, each lobe configured to fit into one of the interfaces.

5. A framework for a stringed musical instrument as claimed in claim 1 wherein each lobed portion is trapezoidal.

6. A framework for a stringed musical instrument as claimed in claim 1 wherein the second interlocking interface in the neck has two channels, the portion of the key that fits into the second interface in the neck has two channels, and each of the channels in the interfaces mates with one of the channels in the portion of the key upon interlocking of the key in the second interface to form an elongated hole.

7. A framework for a stringed musical instrument as claimed in claim 6 wherein a pin is located in the elongated hole.

8. A framework for a stringed musical instrument as claimed in claim 7 further comprising at least one magnet located in the neck and a cover plate held in place by the magnet and covering the pins.

9. A framework for a stringed musical instrument as claimed in claim 8 wherein the magnet is positioned so the coverplate covers the pin.

10. A framework for a stringed musical instrument as claimed in claim 1 further comprising adhesive bonding the proximal end, the outside face and the key.

11. A framework for a stringed musical instrument as claimed in claim 1 wherein the body, neck and key are wood.

12. A framework for a stringed musical instrument as claimed in claim 1 wherein the instrument is selected from the group consisting of guitars, basses, violins, and cellos.

13. A framework for a stringed musical instrument as claimed in claim 1 wherein the interlocking interface in the neck is a first groove that extends substantially perpendicularly to the length of the neck and the interlocking interface in the body is a second groove that extends to a shorter length than the first groove.

14. A framework for a stringed musical instrument comprising:

a wood body having a sound box and a first interlocking interface in an outside face, a wood neck having a distal end and a proximal end and including a heel in the proximal end having a surface with a second interlocking interface in the surface of the heel, wherein the surface intimately touches the outside of the sound box sufficient to provide good sound transmission between the neck and the body, a wood key configured with first and second trapezoidal lobes, one of the lobes configured to interlock with the first interface on the outside face and the other of the lobes configured to interlock with the second interface within the proximal end of the neck, the second interface in the neck having two channels and the lobe of the key that fits into the second interface having two channels positioned so that each of the channels in the second interface opposes one of the channels in the lobe of the key to form an elongated hole, a pin located in each elongated hole, and adhesive bonding the surface of the heel, the outside face of the body and the key.

15. A framework for a stringed musical instrument as claimed in claim 14 further comprising at least one magnet located in the neck and a cover plate held in place by the magnet and covering the pins.

16. A method of securing a neck to a body of a framework for a stringed musical instrument comprising:

forming a first interlocking interface in an outside face of a body, forming a second interlocking interface in a proximal end of a neck, and inserting a key that has first and second portions into the interfaces so that one of the portions of the key interlocks with the first interface on the outside face of the body and the other of the portions of the key interlocks with the second interface within the proximal end of the neck.

17. A method of securing a neck to a body of a framework for a stringed musical instrument as claimed in claim 16 further comprising adding adhesive for bonding the proximal end of the neck, the outside face of the body and the key.

18. A method of securing a neck to a body of a framework for a stringed musical instrument as claimed in claim 16 further comprising placing pins into elongated holes located at boundaries between interlocking interfaces and the key.

* * * * *